US008137054B2

(12) United States Patent
Hofer et al.

(10) Patent No.: US 8,137,054 B2
(45) Date of Patent: Mar. 20, 2012

(54) SUPERSONIC COMPRESSOR

(75) Inventors: Douglas Carl Hofer, Clifton Park, NY (US); Zachary William Nagel, Ballston Lake, NY (US); David Graham Holmes, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 612 days.

(21) Appl. No.: 12/342,278

(22) Filed: Dec. 23, 2008

(65) Prior Publication Data

US 2010/0158665 A1 Jun. 24, 2010

(51) Int. Cl.
*F01D 1/24* (2006.01)

(52) U.S. Cl. ..... 415/66

(58) Field of Classification Search ..... 415/66–69
See application file for complete search history.

(56) References Cited

U.S. PATENT DOCUMENTS

| | | | | |
|---|---|---|---|---|
| 2,623,688 | A * | 12/1952 | Davidson | 415/68 |
| 2,689,681 | A * | 9/1954 | Sabatiuk | 415/69 |
| 2,955,747 | A * | 10/1960 | Schwaar | 415/68 |
| 3,363,831 | A * | 1/1968 | Garnier | 415/65 |
| 7,293,955 | B2 | 11/2007 | Lawlor et al. | |
| 7,334,990 | B2 | 2/2008 | Lawlor et al. | |

OTHER PUBLICATIONS

Co-pending US Patent Application entitled Supersonic Compressor Comprising Radial Flow Path, U.S. Appl. No. 12/491,602, filed on Jun. 25, 2009.

* cited by examiner

*Primary Examiner* — Ross Gushi
(74) *Attorney, Agent, or Firm* — Andrew J. Caruso

(57) ABSTRACT

A novel supersonic compressor is provided by the present invention. In one embodiment, the novel supersonic compressor comprises a fluid inlet, a fluid outlet, and at least two counter rotary supersonic compressor rotors, said supersonic compressor rotors being configured in series such that an output from a first supersonic compressor rotor having a first direction of rotation is directed to a second supersonic compressor rotor configured to counter-rotate with respect to the first supersonic compressor rotor.

20 Claims, 9 Drawing Sheets

SUPERSONIC COMPRESSOR

BACKGROUND

The present invention relates to compressors and systems comprising compressors. In particular, the present invention relates to supersonic compressors comprising supersonic compressor rotors and systems comprising the same.

Conventional compressor systems are widely used to compress gases and find application in many commonly employed technologies ranging from refrigeration units to jet engines. The basic purpose of a compressor is to transport and compress a gas. To do so, a compressor typically applies mechanical energy to a gas in a low pressure environment and transports the gas to and compresses the gas within a high pressure environment from which the compressed gas can be used to perform work or as the input to a downstream process making use of the high pressure gas. Gas compression technologies are well established and vary from centrifugal machines to mixed flow machines, to axial flow machines. Conventional compressor systems, while exceedingly useful, are limited in that the pressure ratio achievable by a single stage of a compressor is relatively low. Where a high overall pressure ratio is required, conventional compressor systems comprising multiple compression stages may be employed. However, conventional compressor systems comprising multiple compression stages tend to be large, complex and high cost. Conventional compressor systems having counter-rotating stages are also known.

More recently, compressor systems comprising a supersonic compressor rotor have been disclosed. Such compressor systems, sometimes referred to as supersonic compressors, transport and compress gases by contacting an inlet gas with a moving rotor having rotor rim surface structures which transport and compress the inlet gas from a low pressure side of the supersonic compressor rotor to a high pressure side of the supersonic compressor rotor. While higher single stage pressure ratios can be achieved with a supersonic compressor as compared to a conventional compressor, further improvements would be highly desirable.

As detailed herein, the present invention provides novel multistage supersonic compressors which provide unexpected enhancements in compressor performance relative to known supersonic compressors.

BRIEF DESCRIPTION

In one embodiment, the present invention provides a supersonic compressor comprising (a) a fluid inlet, (b) a fluid outlet, and (c) at least two counter-rotary supersonic compressor rotors, said supersonic compressor rotors being configured in series such that an output from a first supersonic compressor rotor having a first direction of rotation is directed to a second supersonic compressor rotor configured to counter-rotate with respect to the first supersonic compressor rotor.

In another embodiment, the present invention provides a supersonic compressor comprising (a) a fluid inlet, (b) a fluid outlet, and (c) a first supersonic compressor rotor and a second counter-rotary supersonic compressor rotor, said supersonic compressor rotors being configured in series such that an output from the first supersonic compressor rotor is directed to the second counter-rotary supersonic compressor rotor, said supersonic compressor rotors sharing a common axis of rotation.

In yet another embodiment, the present invention provides a supersonic compressor comprising (a) a gas conduit comprising (i) a low pressure gas inlet, and (ii) a high pressure gas outlet; and (b) a first supersonic compressor rotor disposed within said gas conduit; and (c) a second counter-rotary supersonic compressor rotor disposed within said gas conduit; said supersonic compressor rotors being configured in series such that an output from the first supersonic compressor rotor is directed to the second counter-rotary supersonic compressor rotor, said supersonic compressor rotors defining a low pressure conduit segment upstream of said first supersonic compressor rotor, an intermediate conduit segment disposed between said first supersonic compressor rotor and said second counter-rotary supersonic compressor rotor, and a high pressure conduit segment downstream of said second counter-rotary supersonic compressor rotor, said supersonic compressor rotors sharing a common axis of rotation.

BRIEF DESCRIPTION OF THE DRAWING FIGURES

In order that those of ordinary skill in the art may fully understand the novel features, principles and advantages of present invention, this disclosure provides, in addition to the detailed description, the following figures.

FIG. 1 represents an embodiment of the invention showing a portion of a supersonic compressor comprising a first supersonic compressor rotor and a second counter-rotary supersonic compressor rotor. FIG. 1A represents an embodiment of the invention showing a portion of a supersonic compressor comprising a first supersonic compressor rotor and a second counter-rotary supersonic compressor rotor which is not identical to the first supersonic compressor rotor.

Figure 4:
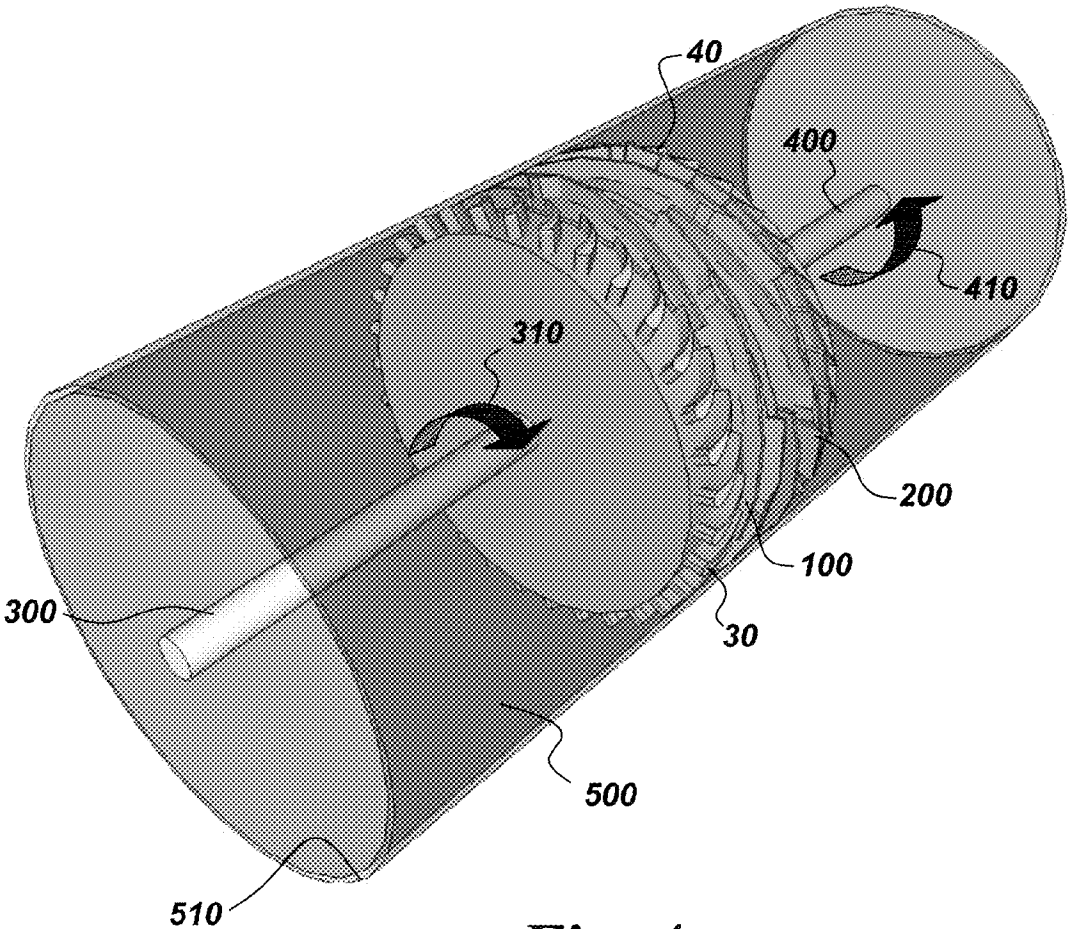
Figure 4A:
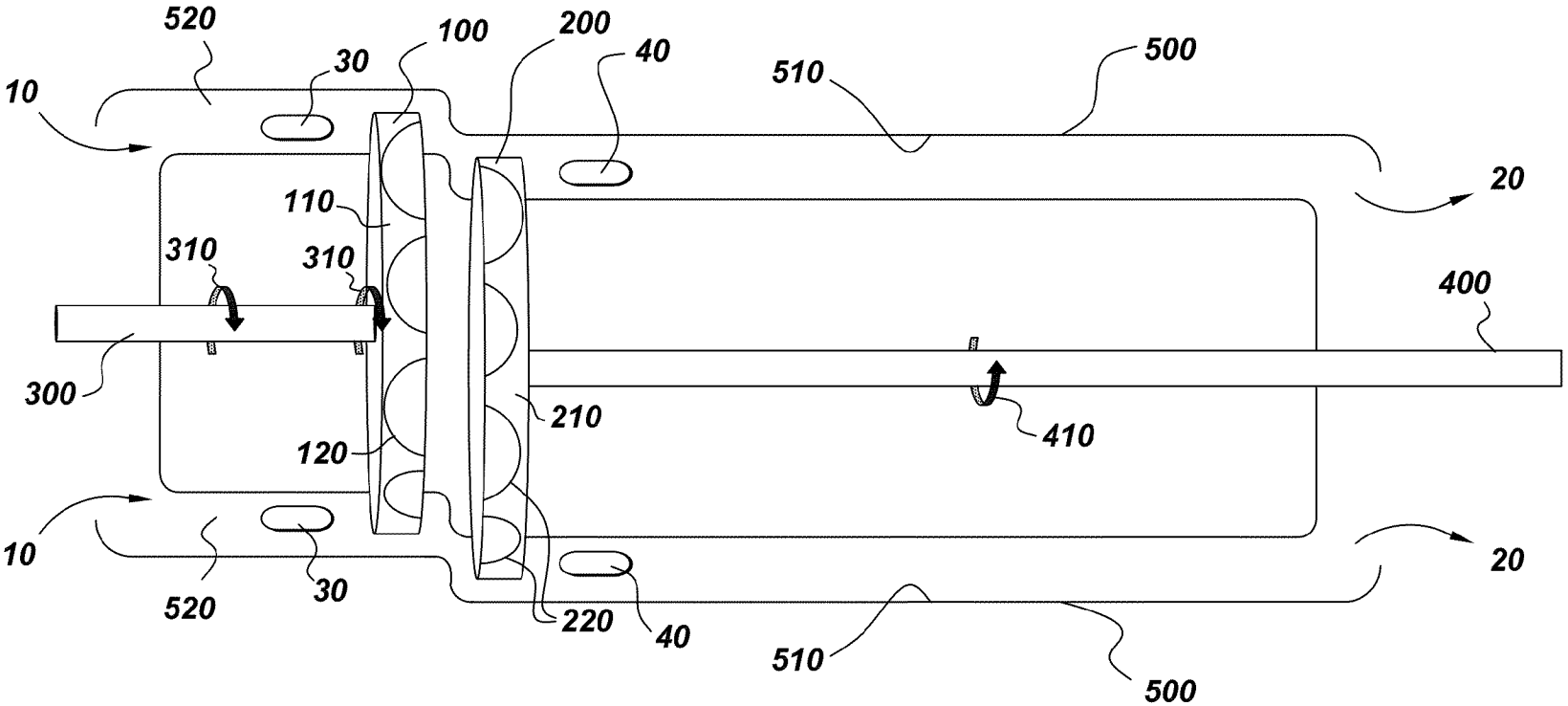
Figure 4B:
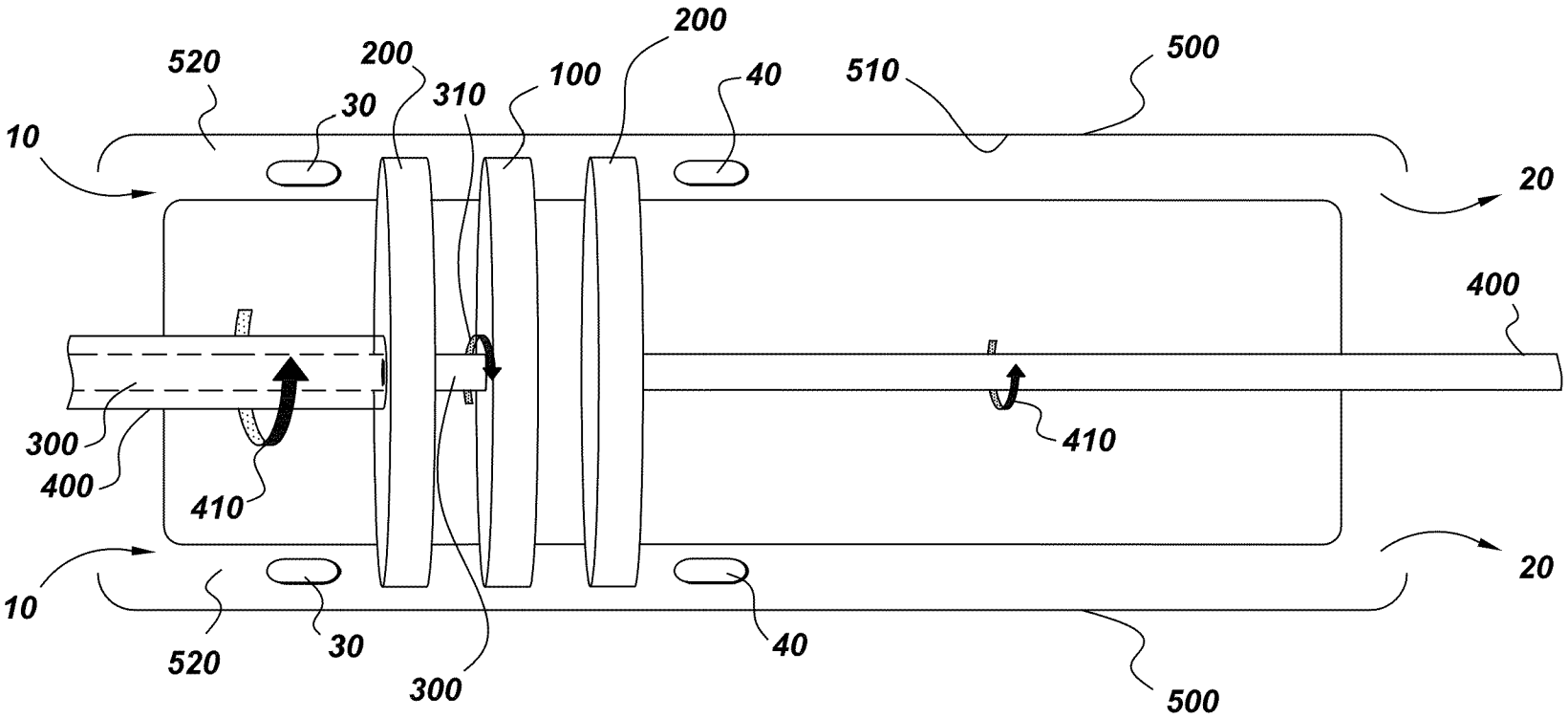
Figure 4C:
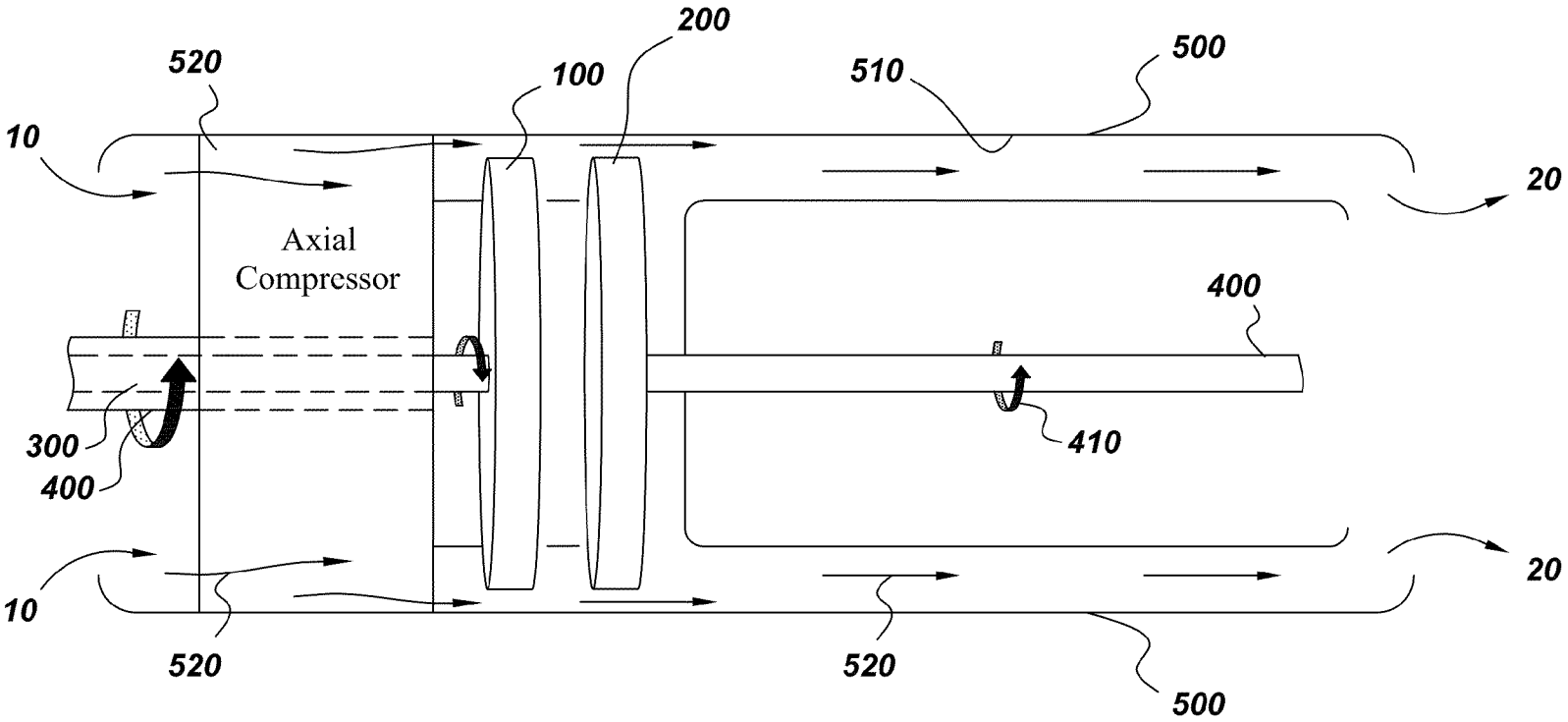

FIG. 4 represents an embodiment of the invention showing a portion of a supersonic compressor comprising a first supersonic compressor rotor and a second counter-rotary supersonic compressor rotor contained within a housing. FIG. 4A represents an embodiment of the invention showing a portion of a supersonic compressor comprising a first supersonic compressor rotor and a second counter-rotary supersonic compressor rotor contained within a housing wherein the supersonic compressor rotors do not share a common axis of rotation. FIG. 4B represents an embodiment of the invention showing a portion of a supersonic compressor comprising at least three supersonic compressor rotors. FIG. 4C represents an embodiment of the invention showing a portion of a supersonic compressor comprising a first supersonic compressor rotor and a second counter-rotary supersonic compressor rotor contained within a housing and further comprising a fluid impeller disposed between a fluid inlet of the supersonic compressor and the first supersonic compressor rotor.

Figure 5:
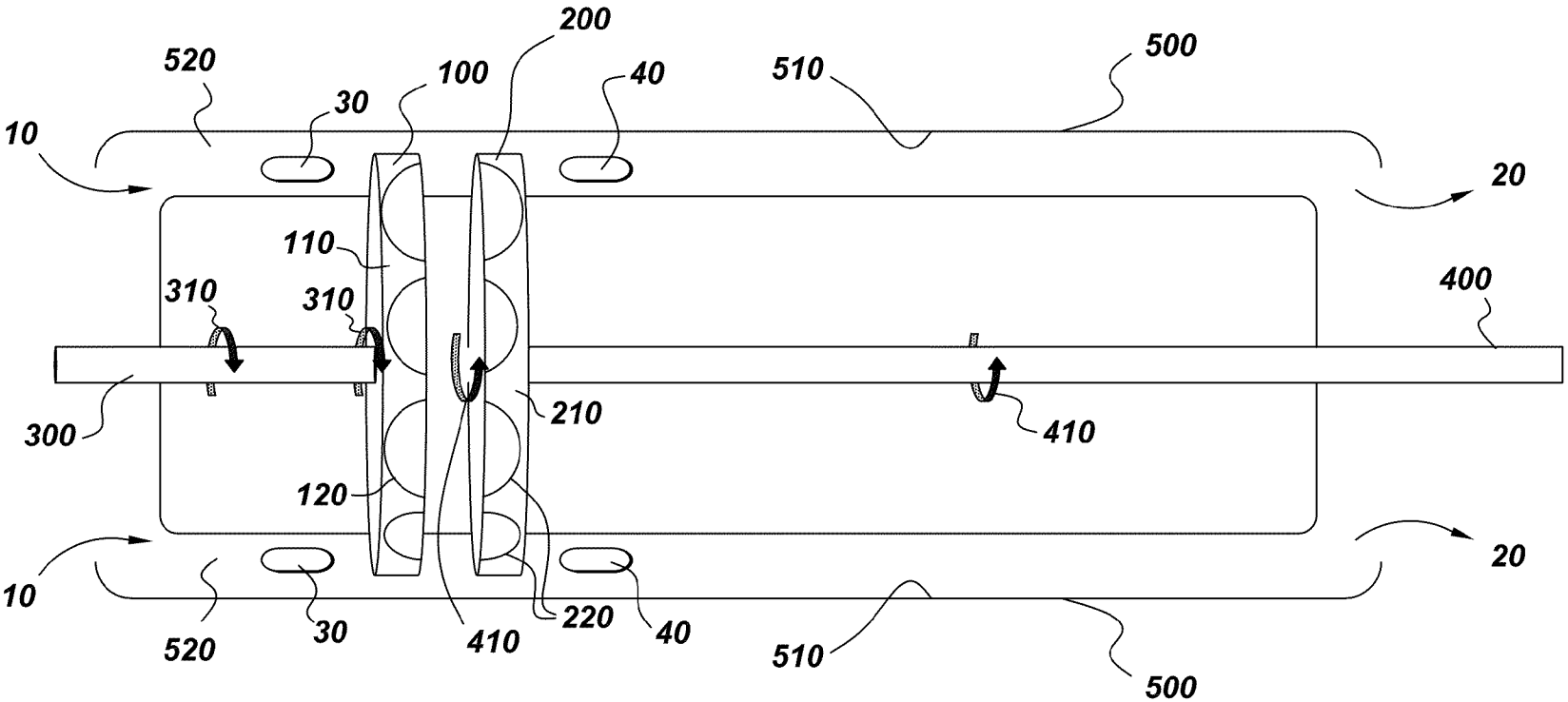

FIG. 5 represents an embodiment of the invention showing a portion of a supersonic compressor comprising a first supersonic compressor rotor and a second counter-rotary supersonic compressor rotor contained within a housing.

Various features, aspects, and advantages of the present invention will become better understood when the following detailed description is read with reference to the accompanying drawings in which like characters represent like parts throughout the drawings. Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

As used herein, the term "supersonic compressor" refers to a compressor comprising a supersonic compressor rotor.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

In contrast to known supersonic compressors, which may comprise one or more supersonic compressor rotors, it has been discovered that significant and unexpected enhancements in compressor performance can be achieved when at least two counter-rotary supersonic compressor rotors configured in series are employed. The novel configuration of supersonic compressor rotors provided by the present invention provides supersonic compressors which are more efficient than supersonic compressors using known configurations of the supersonic compressor rotors. Thus, the present invention provides a supersonic compressor comprising at least two counter-rotary supersonic compressor rotors configured in series. The supersonic compressor provided by the present invention also comprises a fluid inlet and a fluid outlet.

The supersonic compressors provided by the present invention comprise at least two supersonic compressor rotors configured "in series", meaning that an output from a first supersonic compressor rotor having a first direction of rotation is directed to a second supersonic compressor rotor configured to counter-rotate with respect to the first supersonic compressor rotor.

Supersonic compressors comprising supersonic compressor rotors are known to those of ordinary skill in the art and are described in detail in, for example, U.S. Pat. Nos. 7,334,990 and 7,293,955 filed Mar. 28, 2005 and Mar. 23, 2005 respectively, both of which patents are incorporated herein by reference in their entirety, with the proviso that where the disclosure embodied by either of the referenced patents conflicts with a material portion of the instant Application, the instant Application will be considered authoritative.

A supersonic compressor rotor is typically a disk having a first face, a second face, and an outer rim, and comprising compression ramps disposed on the outer rim of the disk, said compression ramps being configured to transport a fluid, for example a gas, from the first face of the rotor to the second face of the rotor when the rotor is rotated about its axis of rotation. The rotor may be rotated about its axis of rotation by means of a drive shaft coupled to the rotor. The rotor is said to be a supersonic compressor rotor because it is designed to rotate about an axis of rotation at high speeds such that a moving fluid, for example a moving gas, encountering the rotating supersonic compressor rotor at a compression ramp disposed upon the rim of the rotor, is said to have a relative fluid velocity which is supersonic. The relative fluid velocity can be defined in terms of the vector sum of the rotor velocity at its rim and the fluid velocity prior to encountering the rim of the rotating rotor. This relative fluid velocity is at times referred to as the "local supersonic inlet velocity", which in certain embodiments is a combination of an inlet gas velocity and a tangential speed of a supersonic ramp disposed on the rim of a supersonic compressor rotor. The supersonic compressor rotors are engineered for service at very high tangential speeds, for example tangential speeds in a range of 300 meters/second to 800 meters/second.

Typically, a supersonic compressor comprises a housing having a gas inlet and a gas outlet, and a supersonic compressor rotor disposed between the gas inlet and the gas outlet. The supersonic compressor rotor is equipped with rim surface structures which compress and convey gas from the inlet side of the rotor to the outlet side of the rotor. In one embodiment, the rim surface structures comprise raised helical structures referred to as strakes, and one or more compression ramps disposed between an upstream strake and a downstream strake. The strakes and the compression ramps act in tandem to capture gas at the surface of the rotor nearest the gas inlet, compress the gas between the rotor rim surface and an inner surface of the housing and transfer the gas captured to the outlet surface of the rotor. The supersonic compressor rotor is designed such that distance between the strakes on the rotor rim surface and the inner surface of the housing is minimized thereby limiting return passage of gas from the outlet surface of the supersonic compressor rotor to the inlet surface.

As noted, the supersonic compressor provided by the present invention comprises at least two counter rotary supersonic compressor rotors in series such that an output from the first supersonic compressor rotor, for example a compressed gas) is used as the input for a second supersonic compressor rotor rotating in a sense opposite that of the rotation of the first supersonic compressor rotor. For example, if the first supersonic compressor rotor is configured to rotate in a clockwise manner, the second supersonic compressor rotor is configured to rotate in a counterclockwise manner. The second supersonic compressor rotor is said to be configured to counter-rotate with respect to the first supersonic compressor rotor.

The first and second supersonic compressor rotors are said to be "essentially identical" when each rotor has the same shape, weight and diameter, is made of the same material, and possesses the same type and number of rim surface features. However, those of ordinary skill in the art will understand that "essentially identical" first and second supersonic compressor rotors will be mirror images of each other. Arrayed in series, two essentially identical counter-rotary supersonic compressor rotors should be mirror images of one another if the movement of a fluid compressed by the two supersonic compressor rotors is to be in the same primary direction. Thus, in one embodiment, the present invention provides a supersonic compressor comprising a first supersonic compressor rotor which is essentially identical to a second supersonic compressor rotor, the two rotors being configured in series, the two rotors being mirror images of one another, the second supersonic compressor rotor being configured to counter-rotate with respect to the first supersonic compressor rotor.

In an alternate embodiment, the supersonic compressor provided by the present invention comprises two counter-rotary supersonic compressor rotors configured in series, wherein the first supersonic compressor rotor is not identical to the second supersonic compressor rotor. As used herein, two counter-rotary supersonic compressor rotors are not identical when the rotors are materially different in some aspect. For example, material differences between two counter-rotary supersonic compressor rotors configured in series include differences in shape, weight and diameter, materials of construction, and type and number of rim surface features. For example, two otherwise identical counter-rotary supersonic compressor rotors comprising different numbers of compression ramps would be said to be "not identical".

Typically, the counter-rotary supersonic compressor rotors configured in series share a common axis of rotation, although configurations in which each of the first supersonic compressor rotor and second supersonic compressor rotor has a different axis of rotation are also possible. In embodiments in which the rotors share a common axis of rotation the rotors are said to be arrayed along a common axis of rotation. Thus, in one embodiment, the present invention provides a supersonic compressor comprising a fluid inlet, a fluid outlet, and at least two counter rotary supersonic compressor rotors configured in series, said rotors being arrayed along a common axis of rotation. In an alternate embodiment, said rotors do not share a common axis of rotation.

The counter-rotary supersonic compressor rotors may be driven by one or more drive shafts coupled to one or more of the supersonic compressor rotors. In one embodiment, each of the counter-rotary supersonic compressor rotors is driven by a dedicated drive shaft. Thus, in one embodiment, the present invention provides a supersonic compressor comprising a fluid inlet, a fluid outlet, and at least two counter rotary supersonic compressor rotors configured in series wherein a first supersonic compressor rotor is coupled to a first drive shaft, and said second supersonic compressor rotor is coupled to a second drive shaft, wherein the first and second drive shafts are arrayed a long a common axis of rotation. As will be appreciated by those of ordinary skill in the art where two counter-rotary supersonic compressor rotors are driven each by a dedicated drive shaft, the drive shafts will in various embodiments themselves be configured for counter-rotary motion. In one embodiment, the first and second drive shafts are counter-rotary, share a common axis of rotation and are concentric, meaning one of the first and second drive shafts is disposed within the other drive shaft. In one embodiment, the supersonic compressor provided by the present invention comprises first and second drive shafts which are coupled to a common drive motor. In an alternate embodiment, the supersonic compressor provided by the present invention comprises first and second drive shafts which are coupled to at least two different drive motors. Those of ordinary skill in the art will understand that the drive motors are used to "drive" (spin) the drive shafts and these in turn drive the supersonic compressor rotors, and understand as well commonly employed means of coupling drive motors (via gears, chains and the like) to drive shafts, and further understand means for controlling the speed at which the drive shafts are spun. In one embodiment, the first and second drive shafts are driven by a counter-rotary turbine having two sets of blades configured for rotation in opposite directions, the direction of motion of a set of blades being determined by the shape of the constituent blades of each set.

In one embodiment, the present invention provides a supersonic compressor comprising at least three counter-rotary supersonic compressor rotors. For example, the supersonic compressor rotors may be configured in series such that an output from a first supersonic compressor rotor having a first direction of rotation is directed to a second supersonic compressor rotor configured to counter-rotate with respect to the first supersonic compressor rotor, and further such that an output from the second supersonic compressor rotor is directed to a third supersonic compressor rotor configured to counter-rotate with respect to the second supersonic compressor rotor.

Those of ordinary skill in the art will understand that the performance of both conventional compressors and supersonic compressors may be enhanced by the inclusion of fluid guide vanes within the compressor. Thus, in one embodiment, the present invention provides a supersonic compressor comprising a fluid inlet, a fluid outlet, at least two counter rotary supersonic compressor rotors configured in series and one or more fluid guide vanes. In one embodiment, the supersonic compressor may comprise a plurality of fluid guide vanes. The fluid guide vanes may be disposed between the fluid inlet and the first (upstream) supersonic compressor rotor, between the first and second (downstream) supersonic compressor rotors, between the second supersonic compressor rotor and the fluid outlet, or some combination thereof. Thus in one embodiment, the supersonic compressor provided by the present invention comprises fluid guide vanes disposed between the fluid inlet and the first (upstream) supersonic compressor rotor, in which instance the fluid guide vanes may be referred to logically as inlet guide vanes (IGV). In another embodiment, the supersonic compressor provided by the present invention comprises fluid guide vanes disposed between the first and second supersonic compressor rotors, in which instance the fluid guide vanes may be referred to logically as intermediate guide vanes (InGV). In another embodiment, the supersonic compressor provided by the present invention comprises fluid guide vanes disposed between the second supersonic compressor rotor and the fluid outlet, in which instance the fluid guide vanes may be referred to logically as outlet guide vanes (OGV). In one embodiment, the supersonic compressor provided by the present invention comprises a combination of inlet guide vanes, outlet guide vanes, and intermediate guide vanes disposed between the first and second supersonic compressor rotors.

In one embodiment, the supersonic compressor provided by the present invention further comprises a conventional centrifugal compressor configured to increase the pressure of a gas being presented to a component supersonic compressor rotor. Thus, in one embodiment, the supersonic compressor provided by the present invention comprises a conventional centrifugal compressor between the fluid inlet and the first supersonic compressor rotor.

For convenience, that portion of the supersonic compressor located between the fluid inlet and the first supersonic compressor rotor may at times herein be referred to as the low pressure side of the supersonic compressor, and that face of the first supersonic compressor rotor closest to the fluid inlet as the low pressure face of the first supersonic compressor rotor. Similarly, that portion of the supersonic compressor located between the first supersonic compressor rotor and the second supersonic compressor rotor may at times herein be referred to as the intermediate pressure portion of the supersonic compressor. Additionally, that portion of the supersonic compressor located between the second supersonic compressor rotor and the fluid outlet may at times herein be referred to as the high pressure side of the supersonic compressor, and that face of the second supersonic compressor rotor closest to the fluid outlet as the high pressure face of the second supersonic compressor rotor. The faces of the first and second supersonic compressor rotors closest to the intermediate pressure portion of the supersonic compressor may at times herein be referred to as the intermediate pressure face of the first supersonic compressor rotor and the intermediate pressure face of the second supersonic compressor rotor respectively.

In one embodiment, the supersonic compressor provided by the present invention is comprised within a larger system, for example a gas turbine engine, for example a jet engine. It is believed that because of the enhanced compression ratios attainable by the supersonic compressors provided by the present invention the overall size and weight of a gas turbine engine may be reduced and attendant benefits derived therefrom.

In one embodiment, the supersonic compressor provided by the present invention comprises (a) a gas conduit comprising (i) a low pressure gas inlet and (ii) a high pressure gas outlet; (b) a first supersonic compressor rotor disposed within said gas conduit; and (c) a second counter-rotary supersonic compressor rotor disposed within said gas conduit; said supersonic compressor rotors being configured in series such that an output from the first supersonic compressor rotor is directed to the second counter-rotary supersonic compressor rotor, said supersonic compressor rotors defining a low pressure conduit segment upstream of said first supersonic compressor rotor, an intermediate pressure conduit segment disposed between said first supersonic compressor rotor and said second counter-rotary supersonic compressor rotor, and a high pressure conduit segment downstream (i.e. located between the second counter-rotary supersonic compressor rotor and the high pressure outlet) of said second counter-rotary supersonic compressor rotor, said supersonic compressor rotors sharing a common axis of rotation. The first and second supersonic compressor rotors may be essentially identical, the first and second supersonic compressor rotors being configured such that the two rotors would appear as mirror images of each other through a reflection plane set between them in an idealized space in which both rotors shared a common axis of rotation. In an alternate embodiment, the first supersonic compressor rotor is not identical to the second counter-rotary supersonic compressor rotor. As used herein, the terms second counter-rotary supersonic compressor rotor and second supersonic compressor rotor are interchangeable. The term second counter-rotary supersonic compressor rotor is used to emphasize the fact that the first and second supersonic compressor rotors are configured to be counter rotary (i.e. configured to rotate in opposite directions). In one embodiment, the first supersonic compressor rotor is coupled to a first drive shaft, and the second counter-rotary supersonic compressor rotor is coupled to a second drive shaft, wherein said first and second drive shafts comprise a pair of concentric, counter-rotary drive shafts.

Figure 1:
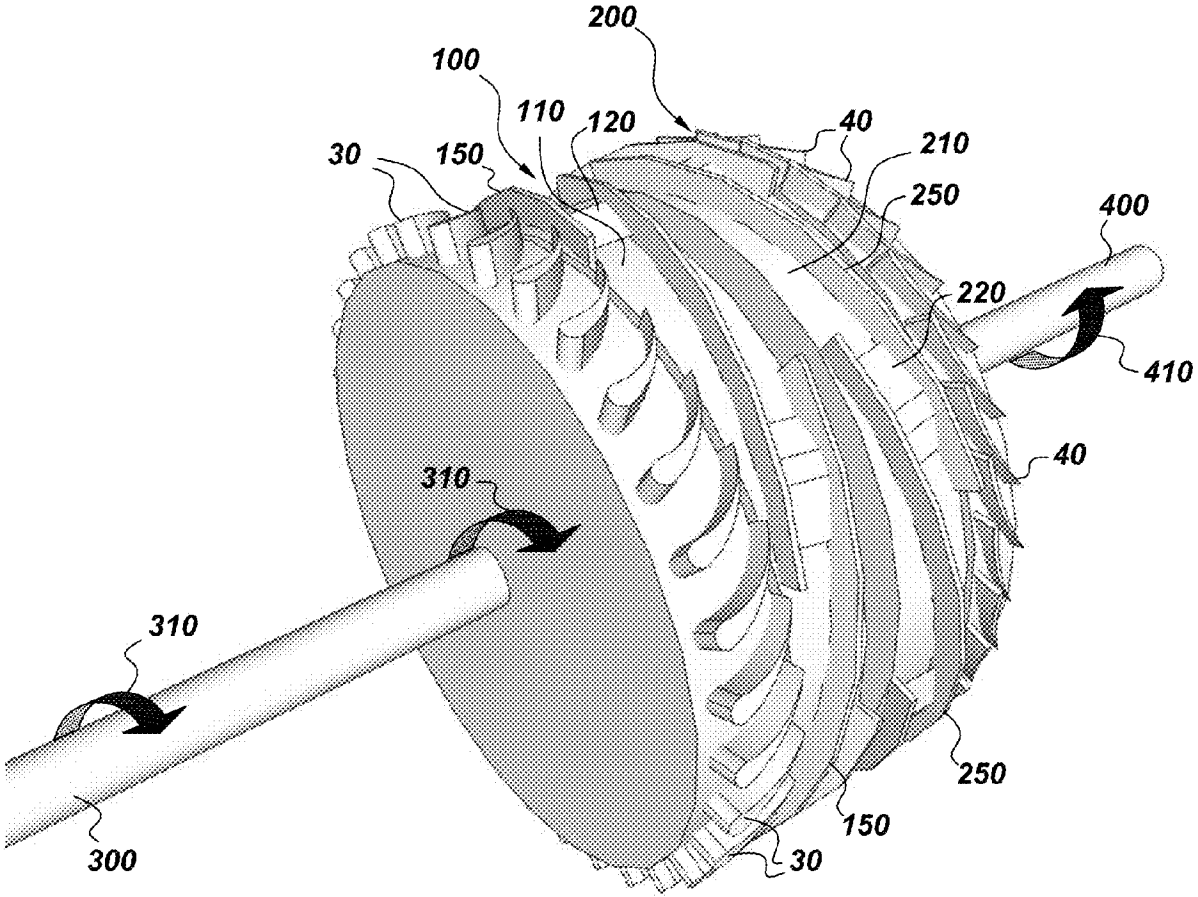
Figure 1A:
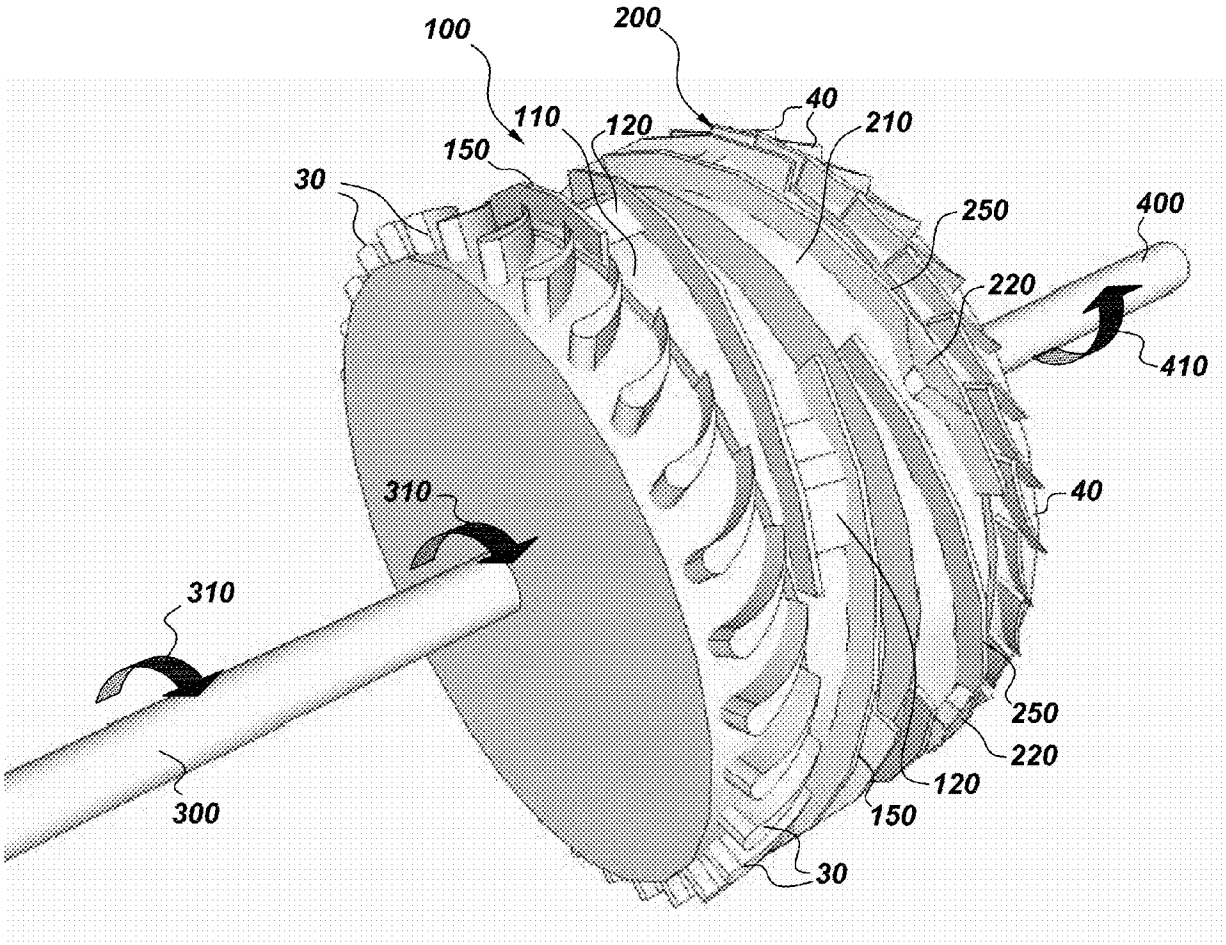

FIG. 1 illustrates an embodiment of the present invention. The figure represents supersonic compressor rotor components and their configuration in a supersonic compressor. Thus, the supersonic compressor comprises a first supersonic compressor rotor 100 driven by a drive shaft 300 in direction 310. The supersonic compressor comprises inlet guide vanes 30 upstream of the first supersonic compressor rotor 100. The supersonic compressor comprises a second counter-rotary supersonic compressor rotor 200 configured in series with the first supersonic compressor rotor 100. The first supersonic compressor rotor 100 comprises rim surface features which include compression ramps 110 and strakes 150 arrayed on outer surface 110. Similarly, the second supersonic compressor rotor 200 comprises rim surface features which include compression ramps 210 and strakes 250 arrayed on outer surface 210. Second supersonic compressor rotor 200 is driven by a drive shaft 400 in direction 410, or counter-rotary with respect to drive shaft 300 and the first supersonic compressor rotor 100. The supersonic compressor further comprises outlet guide vanes 40 downstream of the second supersonic compressor rotor 200.

Figure 2:
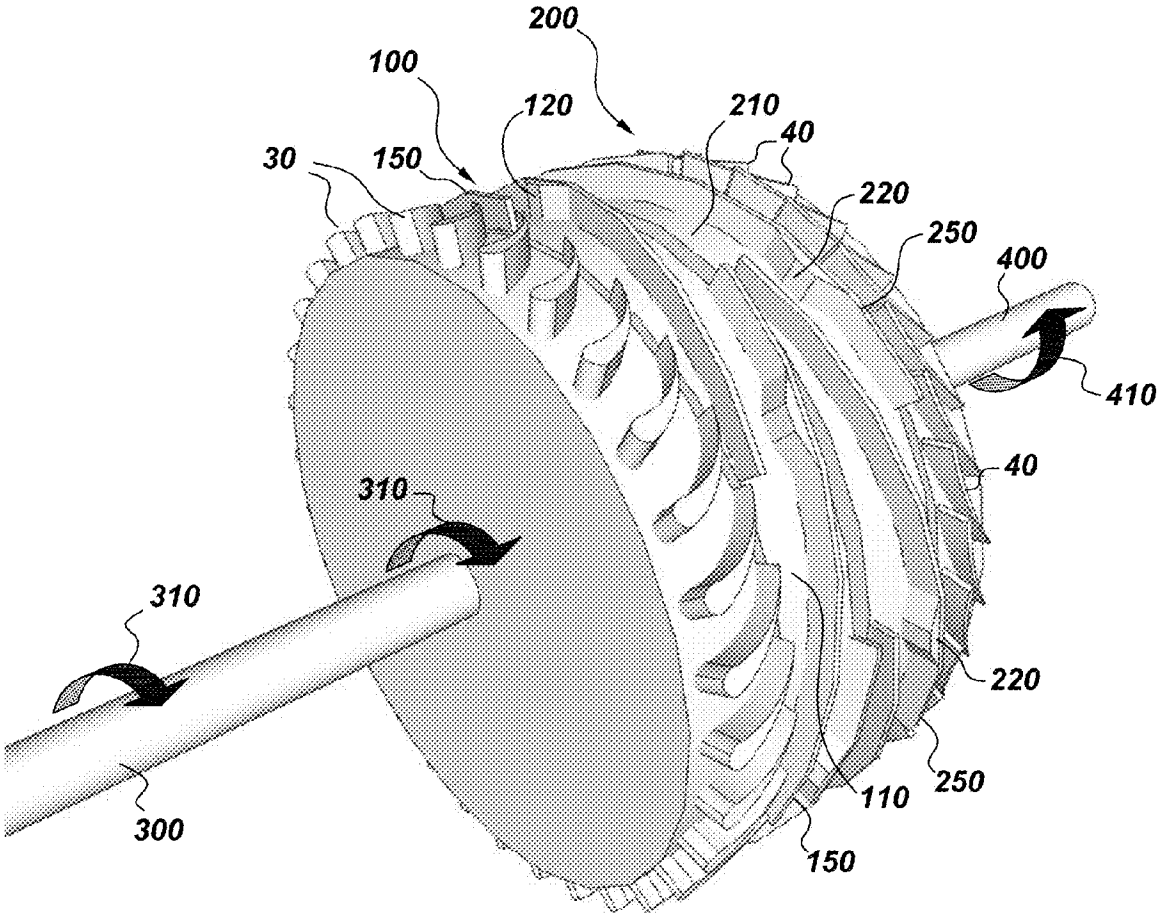
FIG. 2 represents an embodiment of the invention showing a portion of a supersonic compressor comprising a first supersonic compressor rotor and a second counter-rotary supersonic compressor rotor.

FIG. 2 illustrates an embodiment of the present invention. The figure represents supersonic compressor rotor components and their configuration in a supersonic compressor. FIG. 2 features compression ramps 120 and 220 arrayed on rim surfaces 110 and 210 which differ in structure from compression ramps 120 and 220 featured in FIG. 1. With the exception of the structures of the compression ramps, FIGS. 1 and two are intended to be identical.

Figure 3:
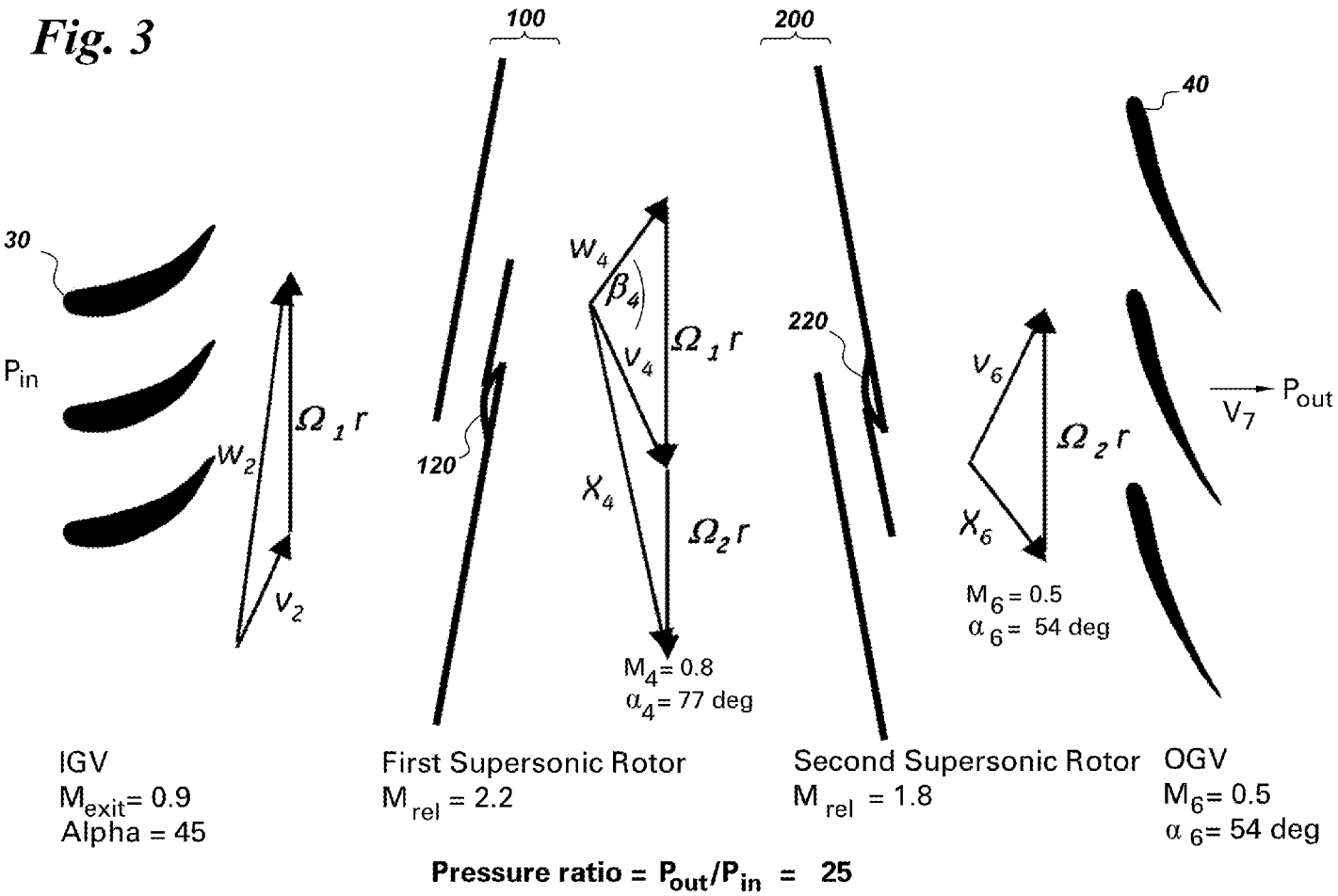
FIG. 3 represents an embodiment of the invention presented conceptually and illustrating the advantages of coupling a first supersonic compressor rotor with a second counter-rotary supersonic compressor rotor.

FIG. 3 illustrates an embodiment of the present invention presented in a conceptual format and is discussed at length below.

FIG. 4 illustrates an embodiment of the present invention. The figure represents supersonic compressor rotor components and their configuration in a supersonic compressor comprising a compressor housing 500 having an inner surface 510. Thus, the supersonic compressor comprises a first supersonic compressor rotor 100 driven by a drive shaft 300 in direction 310. The supersonic compressor comprises inlet guide vanes 30 upstream of the first supersonic compressor rotor 100. The supersonic compressor comprises a second counter-rotary supersonic compressor rotor 200 configured in series with the first supersonic compressor rotor 100. The first and second supersonic compressor rotors comprise rim surface features including compression ramps and strakes arrayed on the outer surface of the rim. Second supersonic compressor rotor 200 is driven by a drive shaft 400 in direction 410, or counter-rotary with respect to drive shaft 300 and the first supersonic compressor rotor 100. The supersonic compressor further comprises outlet guide vanes 40 downstream of the second supersonic compressor rotor 200.

FIG. 5 illustrates an embodiment of the present invention. The figure represents supersonic compressor rotor components and their configuration in a supersonic compressor comprising a compressor housing 500 having, a gas inlet 10, a gas outlet 20, an inner surface 510, and a gas conduit 520. In FIG. 5 the first supersonic compressor rotor 100 and second supersonic compressor rotor are 200 are shown as disposed within the gas conduit 520. Each of the first and second supersonic compressor rotors comprise compression ramps 120 and 220 (respectively) arrayed upon rim surfaces 110 and 210 respectively. First supersonic compressor rotor 100 is driven by drive shaft 300 in direction 310. Second supersonic compressor rotor 200 is configured to counter-rotate with respect to first supersonic compressor rotor 100. Second supersonic compressor rotor 200 is driven by drive shaft 400 in direction 410. The supersonic compressor featured in FIG. 5 comprises inlet guide vanes 30 upstream of first supersonic compressor rotor 100 and outlet guide vanes 40 downstream of second supersonic compressor rotor 200. First supersonic compressor rotor 100 and second supersonic compressor rotor 200 are shown configured in series such that the output of first supersonic compressor rotor 100 is used as the input for second supersonic compressor rotor 200.

Supersonic compressors require high relative velocities of the gas entering the supersonic compression rotor. These velocities must be greater than the local speed of sound in the gas, hence the descriptor "supersonic". For purposes of the discussion contained in this section, a supersonic compressor during operation is considered. A gas is introduced through a gas inlet into the supersonic compressor comprising a plurality of inlet guide vanes (IGV) arrayed upstream of a first supersonic compressor rotor, a second supersonic compressor rotor, and a set of outlet guide vanes (OGV). The gas emerging from the IGV is compressed by the first supersonic compressor rotor and the output of the first supersonic compressor rotor is directed to the second (counter-rotary) supersonic compressor rotor the output of which encounters and is modified by a set of outlet guide vanes (OGV). As the gas encounters the inlet guide vanes (IGV), the gas is accelerated to a high tangential velocity by the IGV. This tangential velocity is combined with the tangential velocity of the rotor and the vector sum of these velocities determines the relative velocity of the gas entering the rotor. The acceleration of the gas through the IGV results in a reduction in the local static pressure which must be overcome by the pressure rise in the supersonic compression rotor. The pressure rise across the rotor is a function of the inlet absolute tangential velocity and the exit absolute tangential velocity along with the radius, fluid properties, and rotational speed, and is given by Equation I wherein $P_1$ is the inlet pressure, $P_2$ is the exit pressure, $\gamma$ is a ratio of specific heats of the gas being compressed, $\Omega$ is the rotational speed, r is the radius, $V_\Theta$ is the tangential velocity, $\eta$ (see exponent) is polytropic efficiency, and $C_{01}$ is stagnation speed of sound at the inlet which is equal to the square root of ($\gamma$*R*$T_0$) where R is the gas constant and $T_0$ is the total temperature if the incoming gas. Those of ordinary skill in the art will recognize Equation I as a form of Euler's equation for turbomachinery.

$$\frac{P_2}{P_1} = \left[1 + \frac{(\gamma - 1)\Omega\Delta(rv_\theta)}{C_{01}^2}\right]^{\frac{\gamma\eta}{\gamma-1}} \qquad \text{Equation I}$$

To achieve high pressure ratios, across a single stage requires a large value of $\Delta(rV_\Theta)$. The inlet guide vane cannot provide all of the required tangential velocity therefore the flow leaving a high pressure ratio compressor will have a high tangential velocity. FIG. 3 illustrates an embodiment of the present invention wherein the ratio of the outlet pressure ($P_{out}$) to the inlet pressure ($P_{in}$) is 25. Values shown in FIG. 3 may be calculated using methods well known to those of ordinary skill in the art. Variables shown in FIG. 3 include: "alpha" (or $\alpha$) which represent an angle relative to stationary inlet guide vanes or outlet guide vanes and referenced to the axis of rotation of the supersonic compressor rotor; "V" which represent velocities relative to a stationary observer such a stationary observer perched on an inlet guide vane or an outlet guide vane; "W" which represent velocities relative to the first supersonic compressor rotor (i.e. the velocity measured by an observer riding the first supersonic compressor rotor); "beta" (or $\beta$) which represent an angle relative to a supersonic compressor rotor and referenced to the axis of rotation of the supersonic compressor rotor; "X" which represent a velocity relative to the second supersonic compressor rotor (i.e. the velocity measured by an observer riding the second supersonic compressor rotor); "omega" (or $\Omega$) which represents the rate of drive shaft rotation in radians per second; "M" which represents the Mach number (flow velocity/local speed of sound); and "r" is the radius of the first and second supersonic compressor rotors. It should be noted that various embodiments of the present invention can achieve such pressure rations in a range of from about 10 to about 100.

In the example shown in FIG. 3 a gas (not shown) encounters inlet guide vanes (IGV) from which the gas emerges and contacts the first supersonic compressor rotor. The gas then contacts the second counter-rotary supersonic compressor rotor and finally a set of outlet guide vanes (OGV). In the example shown in FIG. 3 the flow leaving the first supersonic rotor has a high absolute Mach number ($M_4$) of 0.8 and a highly tangential flow angle ($\alpha_4$) of 77 degrees. A high speed, swirling flow of this type is difficult to diffuse efficiently using a stationary diffuser. This flow is, however, ideal as the input to a second supersonic compressor rotor having rotational direction opposite that of the first supersonic compressor rotor. As shown in FIG. 3, the velocity of the gas flow relative to the second rotor is again supersonic (M=1.8) although at a somewhat lower magnitude than that of the first rotor due to the increase in sound speed with temperature. The flow exiting the second supersonic compressor rotor has a lower absolute Mach number ($M_5$) (0.5) and swirl angle ($\alpha_6$) (54 deg) and represents a flow that is easily diffused in the OGV. In summary the primary benefit for the counter-rotating supersonic compressor is the ability to efficiently utilize the high speed swirling flow at the exit of the first rotor to provide the needed swirl for the second rotor.

The foregoing examples are merely illustrative, serving to illustrate only some of the features of the invention. The appended claims are intended to claim the invention as broadly as it has been conceived and the examples herein presented are illustrative of selected embodiments from a manifold of all possible embodiments. Accordingly, it is Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of." Where necessary, ranges have been supplied, those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

What is claimed is:

1. A supersonic compressor comprising:

(a) a fluid inlet;

(b) a fluid outlet; and (c) at least two counter rotary supersonic compressor rotors, said supersonic compressor rotors being configured in series such that an output from a first supersonic compressor rotor having a first direction of rotation is directed to a second supersonic compressor rotor configured to counter-rotate with respect to the first supersonic compressor rotor;

wherein at least one of the supersonic compressor rotors comprises a rim-mounted compression ramp configured to compress a fluid between a rotor rim surface and an inner surface of a compressor housing.

2. The supersonic compressor according to claim 1, wherein said first supersonic compressor rotor is essentially identical to said second supersonic compressor rotor.

3. The supersonic compressor according to claim 1, wherein said first supersonic compressor rotor is not identical to said second supersonic compressor rotor.

4. The supersonic compressor according to claim 1, wherein said supersonic compressor rotors are arrayed along a common axis of rotation.

5. The supersonic compressor according to claim 1, wherein said supersonic compressor rotors do not share a common axis of rotation.

6. The supersonic compressor according to claim 1, wherein said first supersonic compressor rotor is coupled to a first drive shaft, and said second supersonic compressor rotor is coupled to a second drive shaft, said first and second drive shaft being arrayed along a common axis of rotation.

7. The supersonic compressor according to claim 6, wherein said first and second drive shafts comprise a pair of concentric, counter-rotary drive shafts.

8. The supersonic compressor according to claim 1 comprising at least three supersonic compressor rotors.

9. The supersonic compressor according to claim 1, further comprising one or more of fluid guide vanes.

10. The supersonic compressor according to claim 1 further comprising a fluid impeller between said fluid inlet and said first supersonic compressor rotor.

11. A supersonic compressor comprising:

(a) a fluid inlet;

(b) a fluid outlet; and (c) a first supersonic compressor rotor and a second counter-rotary supersonic compressor rotor, said supersonic compressor rotors being configured in series such that an output from the first supersonic compressor rotor is directed to the second counter-rotary supersonic compressor rotor, said supersonic compressor rotors sharing a common axis of rotation;

wherein at least one of the supersonic compressor rotors comprises a rim-mounted compression ramp configured to compress a fluid between a rotor rim surface and an inner surface of a compressor housing.

12. The supersonic compressor according to claim 11, wherein said first supersonic compressor rotor is essentially identical to said second supersonic compressor rotor.

13. The supersonic compressor according to claim 11, wherein said first supersonic compressor rotor is coupled to a first drive shaft and said second supersonic compressor rotor is coupled to a second drive shaft, wherein said first and second drive shafts comprise a pair of concentric, counter-rotary drive shafts.

14. The supersonic compressor according to claim 13, wherein said first and second drive shafts are coupled to a common drive motor.

15. The supersonic compressor according to claim 11, further comprising a plurality of fluid guide vanes.

16. The supersonic compressor according to claim 11, which is comprised within a gas turbine engine.

17. A supersonic compressor comprising:

(a) a gas conduit comprising (i) a low pressure gas inlet, and (ii) a high pressure gas outlet;

(b) a first supersonic compressor rotor disposed within said gas conduit; and (c) a second counter-rotary supersonic compressor rotor disposed within said gas conduit;

said supersonic compressor rotors being configured in series such that an output from the first supersonic compressor rotor is directed to the second counter-rotary supersonic compressor rotor, said supersonic compressor rotors defining a low pressure conduit segment upstream of said first supersonic compressor rotor, an intermediate pressure conduit segment disposed between said first supersonic compressor rotor and said second counter-rotary supersonic compressor rotor, and a high pressure conduit segment downstream of said second counter-rotary supersonic compressor rotor, said supersonic compressor rotors sharing a common axis of rotation;

wherein at least one of the supersonic compressor rotors comprises a rim-mounted compression ramp configured to compress a fluid between a rotor rim surface and an inner surface of a compressor housing.

18. The supersonic compressor according to claim 17, wherein said first supersonic compressor rotor is essentially identical to said second counter-rotary supersonic compressor rotor.

19. The supersonic compressor according to claim 17, wherein said first supersonic compressor rotor is not identical to said second counter-rotary supersonic compressor rotor.

20. The supersonic compressor according to claim 17, wherein said first supersonic compressor rotor is coupled to a first drive shaft and said second counter-rotary supersonic compressor rotor is coupled to a second drive shaft, wherein said first and second drive shafts comprise a pair of concentric, counter-rotary drive shafts.

* * * * *